United States Patent [19]

Robinson et al.

[11] Patent Number: 5,050,272

[45] Date of Patent: Sep. 24, 1991

[54] CLOSURE MEMBER FOR AN ICE BAG

[75] Inventors: Steven R. Robinson, Hurst; Olifton G. Hampton, Bedford, both of Tex.

[73] Assignee: Anago, Inc., Ft. Worth, Tex.

[21] Appl. No.: 598,357

[22] Filed: Oct. 16, 1990

[51] Int. Cl.[5] ..... B65D 77/10

[52] U.S. Cl. ..... 24/30.5 R; 24/346; 24/543; 604/335

[58] Field of Search ..... 24/305 R, 543, 544, 24/517, 518, 346

[56] References Cited

U.S. PATENT DOCUMENTS

| | | | |
|---|---|---|---|
| 3,523,534 | 8/1970 | Nolan . | |
| 4,038,726 | 8/1977 | Takabayashi | 24/543 |
| 4,275,485 | 6/1981 | Hutchison | 24/30.5 R |
| 4,523,353 | 6/1985 | Hubbard et al. . | |
| 4,551,888 | 11/1985 | Beecher | 24/518 |
| 4,887,335 | 12/1989 | Folkmar | 24/30.5 R |

*Primary Examiner*—Victor N. Sakran
*Attorney, Agent, or Firm*—James E. Bradley

[57] ABSTRACT

A closure member for a bag has a blade and a sheath. The sheath has side walls that are joined on inner edges and open on outer edges. The blade inserts between the side walls. A partition connects between the side walls near a locking end of the sheath. The partition has a shoulder. A retaining wall locates on the locking end of the sheath, spaced longitudinally from the partition. The blade has a locking member that will insert between the retaining wall and the partition. The locking member of the blade has a shoulder that snaps over the shoulder end of the retaining wall.

10 Claims, 3 Drawing Sheets

CLOSURE MEMBER FOR AN ICE BAG

BACKGROUND OF THE INVENTION

1. Field of the invention

This invention relates in general to devices for closing plastic bags against leakage, and in particular to a closure member for use in securing and sealing ice within an ice bag or pack.

2. Description of the Prior Art

Ice packs or bags are used to reduce swelling. A disposable type of bag in use has a plastic liner in which the ice is placed. The plastic liner fits inside a cloth bag, which serves to insulate and provide comfort to the user.

One type of seal for sealing the bag is formed integrally with the bag. The integral sealing member comprises parallel strips on mating sides which interlock with each other to provide sealing. While this seal works well, it requires the user to carefully press the strips together to assure that they close. Otherwise, leakage would occur due to improper closure.

Another type uses a blade and sheath. The plastic bag will be compressed by the blade as it inserts into the sheath. A flexible hinge secures the blade to the sheath on one end. A locking member on the other end is biased outward to engage a locking shoulder formed in the sheath.

While this type is workable, improvements are desirable. More efficient molds are preferable. Also, it would be preferable to utilize a closure member that can be released more easily with a single hand.

SUMMARY OF THE INVENTION

In this invention, the sheath has a partition connected between the sidewalls of the sheath near the locking end of the sheath. The partition has a locking shoulder. A retaining wall locates at the locking end of the sheath. The retaining wall joins the sidewalls of the sheath and extends a short distance along the locking end of the sheath.

The blade has a flexible locking member located at the locking end of the blade. The locking member has a shoulder that locates in a clearance between the locking member and the locking end of the blade. The locking member will insert between the partition and the retaining wall. The shoulder of the locking member will engage the shoulder of the partition.

Also, the locking member has a tip which will protrude past the inner edges of the sheath. This tip allows the user to push the locking member toward the retaining wall to release the blade from the sheath.

The blade preferably has longitudinal ribs that extend along the length for sealing the bag between the ribs and the inner walls of the sheath. The blade connects to the sheath by means of a pin and hook. The pin extends between the sidewalls of the sheath at the pivot end of the sheath. The hook member is located on the pivot end of the blade for engaging the pin.

DETAILED DESCRIPTION OF THE INVENTION

Figures 1, 2, 3:
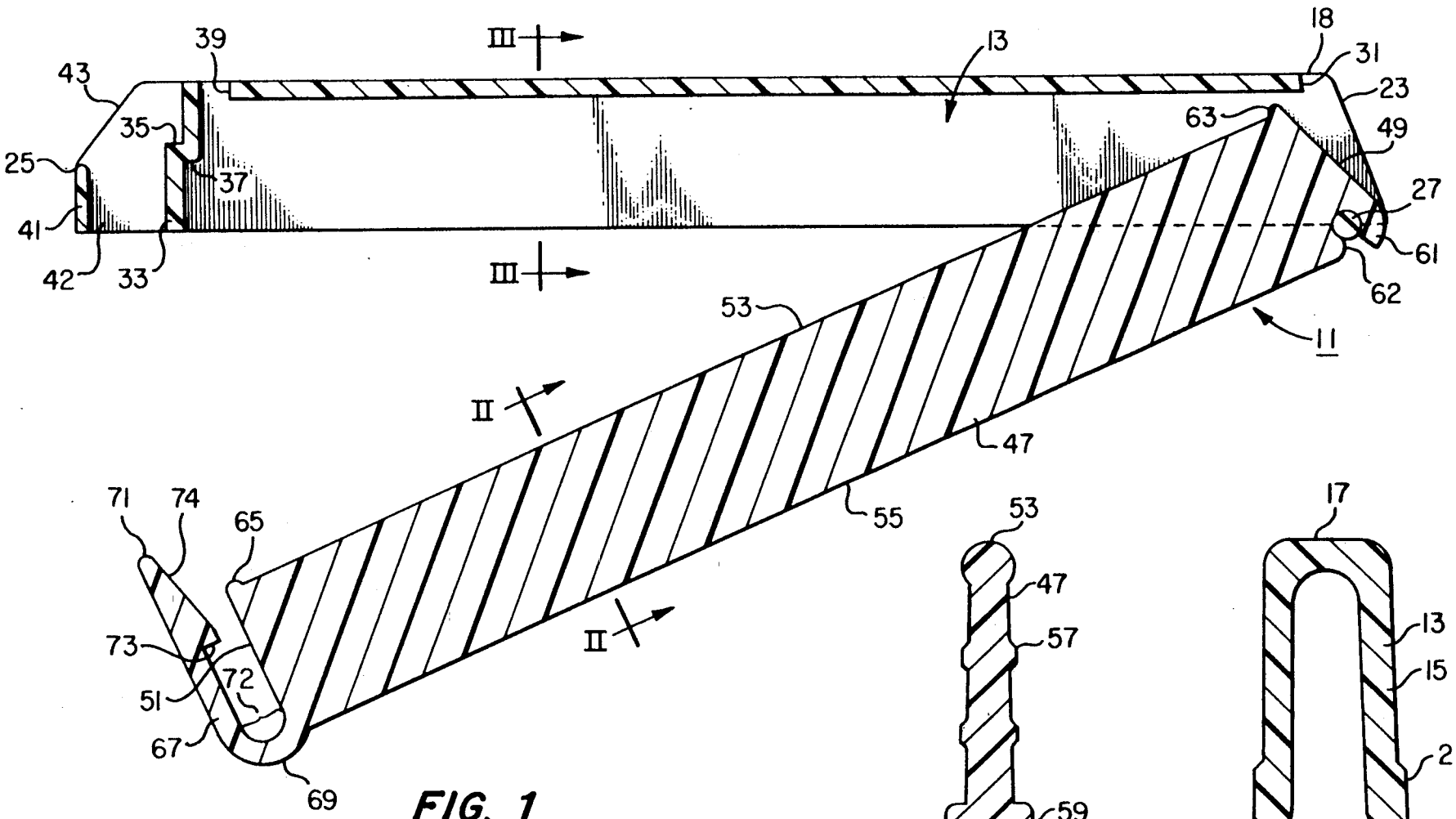
FIG. 1 is a vertical sectional view of a closure member constructed in accordance with this invention.
FIG. 2 is a sectional view of the blade of the closure member of FIG. 1, taken along the line II—II of FIG. 1.
FIG. 3 is a sectional view of the sheath of the closure member of FIG. 1, taken along the line III—III of FIG. 1.
Figure 4:
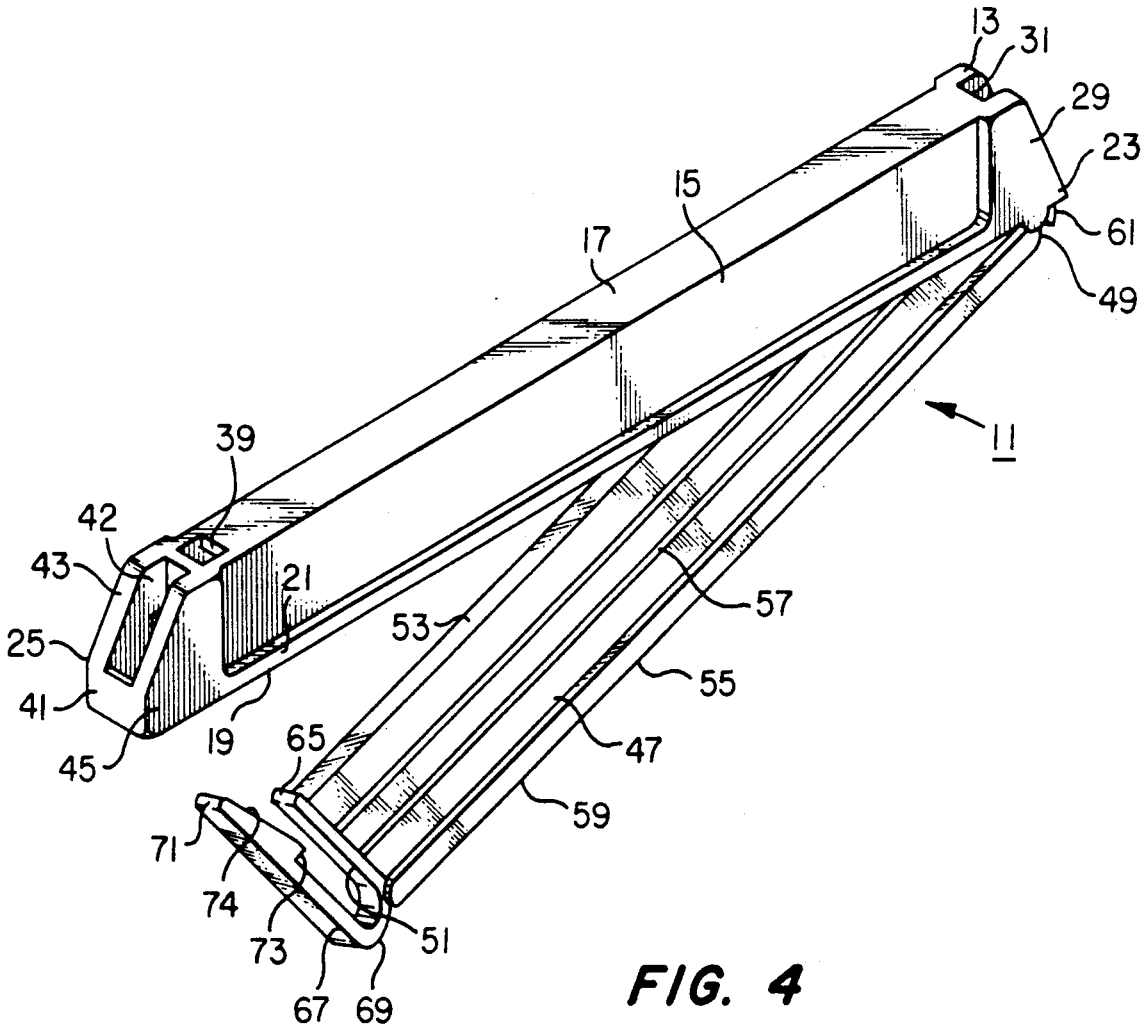
FIG. 4 is a perspective view of the closure member of FIG. 1.

Referring to FIGS. 1 and 4, closure member 11 includes a longitudinal sheath 13. Sheath 13 has parallel, longitudinal side walls 15. A base 17 joins the inner edges 18 of the side walls 15. Base 17 is perpendicular to the side walls 15. The outer edges 19 of the side walls 15 are open and spaced apart from each other to define a slot. A lip 21 extends along the exterior of each side wall 15 at the outer edge 19.

Sheath 13 has a pivot end 23 and a locking end 25. A pin 27, shown in FIG. 1, extends between the side walls 15 at the pivot end 23. As shown in FIG. 4, a stiffening section 29 is integrally formed with each side wall 15 and locates at the exterior of each side wall 15 at the pivot end 23. Referring more particularly to FIG. 1, the base 17 has a pivot end 31 that is spaced a short distance inward from the locked pivot end 23 of the side walls 15. The pivot end 23 of each side wall 15 is not perpendicular to the parallel inner and outer edges 18, 19, rather it is inclined at an angle of about 110 degrees relative to the inner edge 18.

Sheath 13 includes a partition 33 which is located near the locking end 25. Partition 33 extends from the inner edge 18 to the outer edge 19. Partition 33 is an integrally formed web between the side walls 15. Partition 33 has a locking shoulder 35 that faces toward the inner edge 18. Partition 33 is uniform in thickness, resulting in a shoulder 37 on the pivot end side of the partition 33. Shoulder 37 faces toward the outer edge 19. Shoulder 35 is parallel to the inner and outer edges 18, 19 and located about midway between the inner and outer edges 18, 19.

The base 17 has a locking end 39 that is spaced from the partition 33. This results in a clearance between the base locking end 39 and the partition 33. In this clearance, the side walls 15 of sheath 13 are not joined to each other.

A retaining wall 41 locates at the locking end 25 of sheath 13 Retaining wall 41 is parallel to the partition 33, and thus perpendicular to the side walls 15. Retaining wall 41 extends from the outer edges 19 of side walls 15 and joins the side walls 15 for a selected distance toward the inner edges 18. The retaining wall 41 extends for a length that is less than the distance from the inner edge 18 to the locking shoulder 35. The distance is approximately the same as the distance from the outer edge 19 to the shoulder 37.

The partition 33 and retaining wall 41 define a slot 42 between them. The inner edges 18 of the side walls 15 have a recessed section 43. Recessed section 43 begins at the retaining wall 41 and extends at an angle of about 130 degrees relative to the retaining wall 41. The inclined recessed section 43 joins the portion of the inner edge 18 at a point between the retaining wall 41 and partition 33. As shown in FIG. 4, a stiffening section 45 locates at the locking end 25. The stiffening section 45 comprises a thicker section of side walls 15, and joins lip 21.

Closure member 11 includes a blade 47 that will snap into sheath 13. Blade 47 has a pivot end 49 and a locking end 51. Blade 47 has an inner edge 53 that will locate between the side walls 15 adjacent base 17. Blade 47 has an outer edge 55 that will locate outward of the sheath side wall outer edges 19.

Referring to FIG. 2, a plurality of longitudinal ribs 57 extend along the length of blade 47. Ribs 57 locate on each side of blade 47 and protrude outward. Ribs 57 are parallel to each other and frictionally engage the interior surfaces of the side walls 15. The inner edge 53 includes one of the ribs 57, as shown in FIG. 2. A base 59 of blade 47 extends along the outer edge 55. Base 59 is rectangular in cross section and thicker than the remaining thickness of the blade 47. Base 59 locates on the outside of sheath 13 when the blade 47 is in the closed position.

Blade 47 has a hook 61 on its pivot end 49. Hook 61 locates at the outer edge 55. Hook 61 defines a circular slot 62 for snapping over the pin 27. When snapped in place, hook 61 and pin 27 serve as means for allowing the blade 47 to rotate or pivot between the open position shown in FIG. 1 and a closed position, shown partially in FIG. 6. Base 47 has a greater transverse width than the distance between the outer edges 19 of the sheath 13. Portions of base 47 will contact the outer edges 19 of sheath 13 when the blade 47 is in the closed position.

Blade 47 has a pair of small protuberances 63, 65 on its inner edge 53. Each protuberance 63, 65 extends inward beyond the inner edge 53 a short distance. Protuberance 63 locates next to the pivot end 31 of base 17 when blade 47 is in the closed position. Protuberance 65 locates in the clearance between the base locking end 39 and the partition 33 when blade 47 is in the closed position.

A locking member 67 extends from the locking end 51 of blade 47. Locking member 67 is resilient. It has a U-shaped section 69 that joins the outer edge 55 and the locking end 51 of the blade 47. The locking member 67 extends inward, perpendicular to the blade outer edge 55. A tip 71 locates on the end of the locking member 67. Tip 71 protrudes past the inner edge 53 of blade 47. A clearance 72 will be between the locking end 51 and locking member 67.

Figure 6:
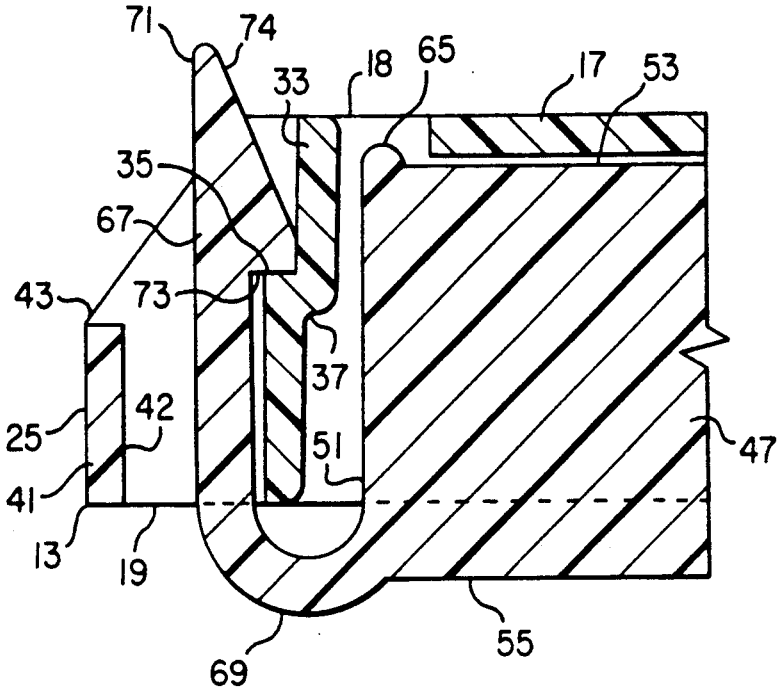
FIG. 6 is an enlarged, partial, sectional view of the closure member of FIG. 1, showing the blade in a closed position.

A locking shoulder 73 locates in the clearance 72 on the side of locking member 67 that faces the locking end 51 of blade 47. Shoulder 73 is parallel to outer edge 55 and faces in the direction of outer edge 55. As shown in FIG. 6, locking member shoulder 73 is positioned to frictionally engage the partition locking shoulder 35 when the blade 47 is in the locked position shown in FIG. 6. Cam surface 74 inclines between the shoulder 73 and the tip 71. The locking member 67 is thicker at the shoulder 73 than at the tip 71.

Figure 5:
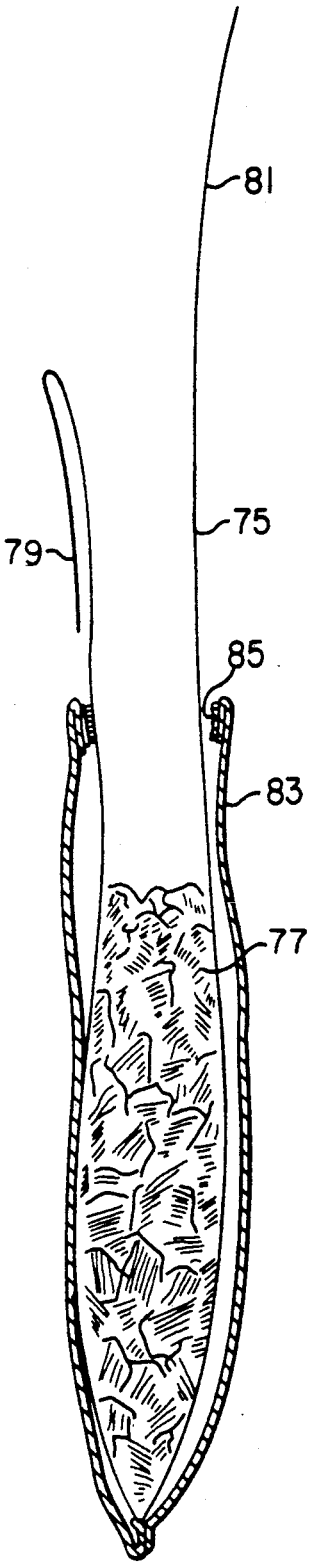
FIG. 5 is a schematic view illustrating an ice bag for use with the closure member of FIG. 1.

Referring to FIG. 5, the closure member 11 (FIG. 4) will be utilized with an ice bag 75. Ice bag 75 is a plastic flexible bag for receiving ice 77. A flap 79 on one end serves as a hand hold. A loading chute 81 locates on the other end. The ice bag 75 fits within a cloth bag 83 for insulation. Securing strips 85 will secure the cloth bag 83 when the ice bag 75 is sealed with a closure member 11 (FIG. 4).

Figure 7:
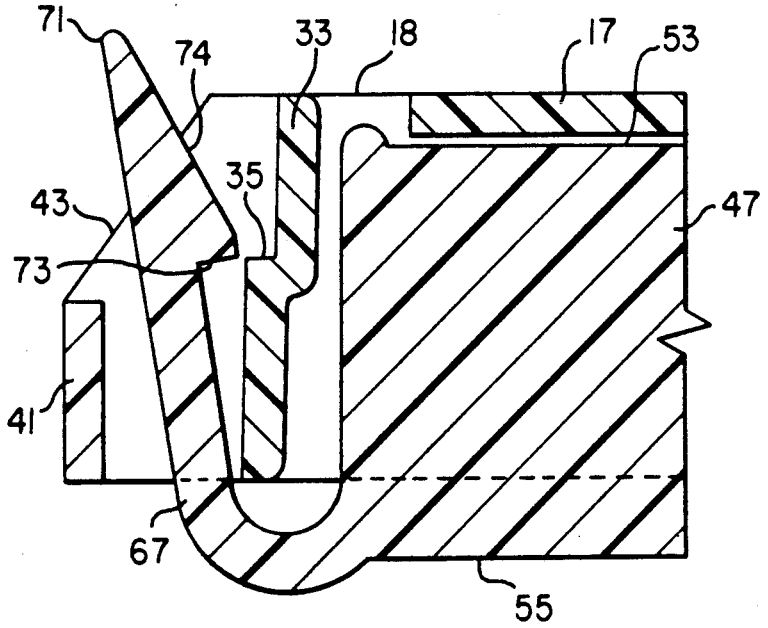
FIG. 7 is an enlarged, partial, sectional view of the closure member of FIG. 1, showing the locking member being pulled back in order to release the blade from the closed position.

Referring to the figures, to seal the ice bag 75, the closure member 11 may be opened by pressing cam surface 74 in a direction toward the retaining wall 41. When the shoulder 73 clears the shoulder 35, as shown in FIG. 7, pressing downward on tip 71 will cause the blade 47 to move to the open position shown in FIG. 4. The slot 42 between the retaining wall 41 and the partition 33 will accommodate the locking member 67 as it moves between the open and closed positions.

After filling with ice 77, the sides of the bag 75 will be placed in contact with each other below the flap 79. The closure member will be inserted over this portion of bag 75. The protuberances 63, 65 serve as guides for placement of the bag 75. The user will then press the blade 47 toward the sheath 13. The locking member 67 will slide through slot 42. The cam surface 74 will slide on the partition 33. The resilient bias of the locking member 67 pulls the locking member 67 toward the blade 47. Once the locking member shoulder 73 reaches the partition shoulder 35, it will slide over to the position shown in FIG. 6.

The ribs 57 will press the sides of the bag 75 tightly against the interior surfaces of the sheath side walls 15. Each rib 57 forms an independent seal. The flap 79 and loading chute 81 will be folded over and inserted with the closure member 11 into the bag 83. The bag 83 will be closed with the strips 85.

The invention has significant advantages. The locking member readily opens utilizing only one hand. The retaining wall serves to protect the locking member from inadvertent opening. The separate pieces of the blade and sheath allow more efficient molding. The ribs form multiple independent seals.

While the invention has been shown in only one of its forms, it should be apparent to those skilled in the art that it is not so limited, but is susceptible to various changes without departing from the scope of the invention.

We claim:

1. In a closure member for a bag, the closure member having a sheath with generally parallel side walls, the side walls having inner edges joining each other and outer edges spaced apart from each other, the sheath having a pivot end and a locking end, the closure member having a blade with a pivot end which pivotally connects to the pivot end of the sheath and a locking end, the blade being rotatable about its pivot end between an open position exterior of the sheath and a closed position snapped into the sheath, the blade having an outer edge and a parallel inner edge, the inner edge of the blade locating in the sheath when the blade is in the closed position, the improvement comprising in combination:

a partition connected between the side walls of the sheath near the locking end of the sheath, the partition having a first side facing the pivot end of the sheath and a second side facing the locking end of the sheath, the partition having a shoulder which faces toward the inner edges of the side walls of the sheath;

a retaining wall located at the locking end of the sheath, the retaining wall joining the side walls of the sheath and extending from the outer edges of the side walls a selected distance toward the inner edges of the side walls;

the inner edges of the side walls of the sheath between the retaining wall and the partition being separated from each other; and a flexible locking member located at the locking end of the blade, the locking member joining the outer edge of the blade and extending in a direction toward the inner edge of the blade, terminating in a tip which extends past the inner edge of the blade, the locking member being separated from the locking end of the blade by a clearance, the locking member having a shoulder located in the clearance which faces toward the outer edge of the blade; and wherein in the closed position, the locking member locates between the retaining wall and the partition with the shoulder of the locking member engaging the shoulder of the partition and the tip protruding past the inner edges of the side wall of the sheath, to enable the tip to be engaged by a user for releasing the locking member from the partition, if desired.

2. The closure member according to claim 1 wherein the inner edges of the side wall have a recessed section that extend from the retaining wall toward the partition, the recessed section inclining relative to the inner edges of the side walls between the partition and the pivot end, to provide space for the tip and locking member to be pulled away from the shoulder of the partition to release the locking member.

3. The closure member according to claim 1 wherein the retaining wall extends no greater than the distance from the outer edges of the sheath to the shoulder of the partition.

4. In a closure member for a bag, the closure member having a sheath with generally parallel side walls, the side walls having inner edges joining each other and outer edges spaced apart from each other, the sheath having a pivot end and a locking end, the closure member having a blade with a pivot end and a locking end, the blade being rotatable about its pivot end between an open position exterior of the sheath and a closed position snapped into the sheath, the blade having an outer edge and a parallel inner edge, the inner edge of the blade locating in the sheath when the blade is in the closed position, the improvement comprising in combination:

a pin extending between the side walls of the sheath at the pivot end of the sheath, the pin being located at the outer edges of the side walls of the sheath;

a hook member formed on the pivot end of the blade at the outer edge of the blade, the hook member being snapped onto the pin to enable rotation of the blade about the pin;

a partition connected between the side walls of the sheath near the locking end of the sheath and extending from the inner edges of the side walls to the outer edges of the side walls, the partition having a first side facing the pivot end of the sheath and a second side facing the locking end of the sheath, the partition having a shoulder which faces toward the inner edges of the side walls of the sheath;

the inner edges of the side walls of the sheath between the locking end of the sheath and the partition being separated from each other and having a recessed section of which at least a portion is closer to the outer edges of the side walls than the inner edges between the partition and the pivot end of the sheath;

a flexible locking member located at the locking end of the blade, the locking member joining the outer edge of the blade and extending in a direction toward the inner edge of the blade, terminating in a tip which extends past the inner edge of the blade, the locking member being separated from the locking end of the blade by a clearance, the locking member having a shoulder located in the clearance which faces toward the outer edge of the blade; and wherein in the closed position, the locking member locates between the side walls of the sheath between the locking end of the sheath and the partition, with the shoulder of the locking member engaging the shoulder of the partition and the tip protruding past the recessed section of the inner edges of the side wall of the sheath, to enable the tip to be engaged by a user for releasing the locking member from the partition, if desired.

5. The closure member according to claim 4 wherein the recessed section of the inner edges of the sheath is inclined relative to the inner edges of the sheath between the partition and the pivot end of the sheath.

6. The closure member according to claim 4 further comprising:

a plurality of ribs formed on opposite sides of the blade and extending parallel to each other and to the inner and outer edges of the blade.

7. In a closure member for a bag, the closure member having a sheath with generally parallel side walls, the side walls having inner edges joining each other and outer edges spaced apart from each other, the sheath having a pivot end and a locking end, the closure member having a blade with a pivot end and a locking end, the blade being rotatable about its pivot end between an open position exterior of the sheath and a closed position snapped into the sheath, the blade having an outer edge and a parallel inner edge, the inner edge of the blade locating in the sheath when the blade is in the closed position, the improvement comprising in combination:

a partition connected between the side walls of the sheath near the locking end of the sheath, the partition having a first side facing the pivot end of the sheath and a second side facing the locking end of the sheath, the partition having a shoulder which faces toward the inner edges of the side walls of the sheath;

a retaining wall located at the locking end of the sheath, the retaining wall joining the side walls of the sheath and extending from the outer edges of the side walls for a distance that is substantially no greater than the distance from the outer edges of the sheath to the shoulder of the partition;

the inner edges of the side walls of the sheath between the retaining wall and the partition being separated from each other and having a recessed section which begins at the retaining wall and which at least a portion is closer to the outer edges of the side walls than the inner edges between the partition and the pivot end of the sheath; and a flexible locking member located at the locking end of the blade, the locking member joining the outer edge of the blade and extending in a direction toward the inner edge of the blade, terminating in a tip which extends past the inner edge of the blade, the locking member being separated from the locking end of the blade by a clearance, the locking member having a shoulder located in the clearance which faces toward the outer edge of the blade; and wherein in the closed position, the locking member locates between the retaining wall and the partition with the shoulder of the locking member engaging the shoulder of the partition and the tip protruding past the recessed section of the inner edges of the side wall of the sheath, the locking member being biased toward the pivot end of the blade when the blade is in the closed position.

8. The closure member according to claim 7 further comprising:

a pin extending between the side walls of the sheath at the pivot end of the sheath, the pin being located at the outer edges of the side walls of the sheath; and a hook member formed on the pivot end of the blade at the outer edge of the blade, the hook member being snapped onto the pin to enable rotation of the blade about the pin.

9. The closure member according to claim 7 further comprising:

a plurality of ribs formed on opposite sides of the blade and extending parallel to each other and to the inner and outer edges of the blade.

10. The closure member according to claim 7 wherein the recessed section of the inner edges of the sheath is inclined relative to the inner edges of the sheath between the partition and the pivot end of the sheath.

* * * * *